US005890249A

United States Patent [19]

Hoffman

[11] Patent Number: 5,890,249

[45] Date of Patent: Apr. 6, 1999

[54] MULTI-PURPOSE VIBRATION CLEANING DEVICE

[76] Inventor: Gary P. Hoffman, 1500 Washington Ave., West Islip, N.Y. 11795

[21] Appl. No.: 859,179

[22] Filed: May 20, 1997

[51] Int. Cl.[6] ..... A47L 11/12; A47L 1/02; A46B 13/02

[52] U.S. Cl. ..... 15/4; 15/22.1; 15/97.1

[58] Field of Search ..... 15/4, 22.1, 97.1

[56] References Cited

U.S. PATENT DOCUMENTS 3,972,088 8/1976 Thomas ..... 15/22.1
4,250,586 2/1981 Timian ..... 15/97.1
4,380,092 4/1983 Brothers ..... 15/97.1
5,187,827 2/1993 Wei .

*Primary Examiner*—Randall E. Chin
*Attorney, Agent, or Firm*—Collard & Roe, P.C.

[57] ABSTRACT

A multi-purpose cleaner incorporates a vibration generator selectively controlled by a switch. The vibration generator vibrates a dual sided cleaning head to provide superior cleaning action. A pivotal joint and rotatable extension member provide the dual sided head with freedom of motion in three dimensions. The dual sided cleaning head includes releasable cleaning surfaces that can be selectively changed according to any desired cleaning application.

6 Claims, 3 Drawing Sheets

MULTI-PURPOSE VIBRATION CLEANING DEVICE

BACKGROUND OF THE INVENTION

1. Field of the Invention

The present invention relates to cleaning devices. More particularly, it relates to a multi-purpose cleaning device that utilizes vibration generators and a dual sided cleaning head to produce superior cleaning action.

2. The Prior Art

U.S. Pat. No. 5,187,827 to Wei, discloses a multi-purpose cleaning device that utilizes a rotary wheel mounted on the end of an hand held device. The rotational motion of the wheel is generated by water pressure applied to the cleaning head through a flow device. As the water pressure increases, the cleaning head vibrates to aid in the cleaning process. An additional detergent line is disclosed as being connected to the rotating head, and enables the user to dispense a detergent while the water is flowing from the head.

SUMMARY OF THE INVENTION

The present invention provides a multi-purpose cleaning device for all household cleaning applications.

According to the invention, a vibration generator is disposed inline with a handle and a rotatable extension member. A dual sided cleaning head is pivotally coupled to the opposite end of the extension member. The extension member is rotatable up to 180° and enables the cleaning head to be rotated 180° such that each side of the cleaning head can be used for the same or different cleaning applications.

A pivotal adjustment or ball joint is provided at the connection between the cleaning head and the extension member. The pivotal adjustment and rotatable lower extension provides the cleaning head with a full range of motion in three dimensions.

It is therefore an object of the present invention to provide a multi-purpose cleaning device that utilizes vibration generators.

It is another object of the invention to provide a multi-purpose cleaning device that has a dual sided cleaning head for performing two different cleaning applications.

Yet another object of the invention is to provide a multi-purpose cleaning device that operates efficiently and reliably.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
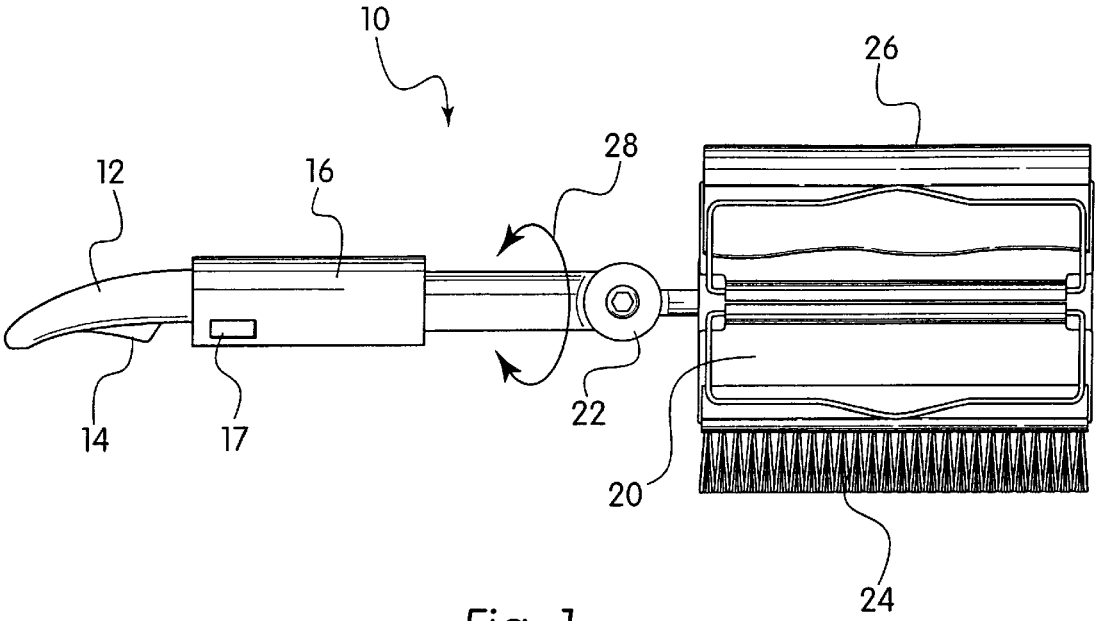
FIG. 1 is a side plan view of the multi-purpose cleaner according to the invention.

Turning now in detail to the drawings, FIG. 1 shows the multi-purpose cleaner 10 according to the invention. Cleaner 10 has a handle grip 12 with an on/off switch 14 positioned thereon. A vibration generator 16 is coupled to handle 12, and is electrically controlled by on/off switch 14. An internal rechargeable battery 17 provides DC power to cleaner 10. Vibration generator 16 is preferably sealed from moisture to allow cleaner 10 to be used in and around wet environments.

Extension member 18 is rotatably coupled to vibration unit 16 as indicated by arrows 28, and includes an adjustable index 22 at its opposite end for varying the position of cleaning head 20. The rotatable connection between each member 18 and vibration unit 16 is also sealed from moisture to enable the use of cleaner 10 in and around water. Extension 18 has a range of rotation of 0–180° which enables the use of two operable cleaning surfaces 24 and 26 on cleaning head 20. Index 22 can be infinitely adjusted in pivotal directions 42*a* and 42*b* to provide a more versatile cleaning head action.

Figure 2:
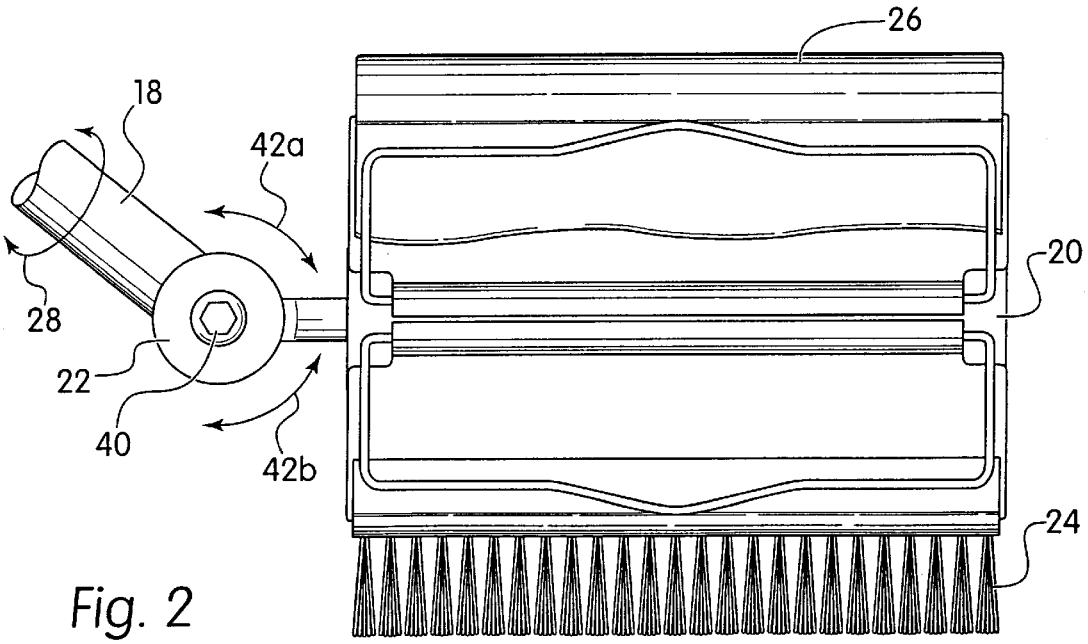
FIG. 2 is a plan view of the cleaning head according to the invention.

FIG. 2 shows cleaning head 20 with two cleaning surfaces 24 and 26. The combination of the rotational motion 28 of extension 18, and pivotal action 42*a* and 42*b* of index 22 around nut 40 enables the user to use one cleaning side 24 for a first set of cleaning applications, and the other cleaning side 26 for a second set of cleaning applications. In the preferred embodiment multi-purpose cleaning device 10 is a Power Window Washer with cleaning sides 24 and 26 being adapted for the same.

During operation, vibration generator 16 is activated by switch 14. Vibration generator 16 causes lower extension 18 and cleaning head 20 to vibrate. This vibrating action, in conjunction with the movement of the cleaning head across the surface to be cleaned, provides a superior cleaning action. The vibration or oscillation of cleaning head 20 facilitates the removal of dirt from the surfaces being cleaned by lowering the apparent frictional resistance between the dirt, the surface, and the user's cleaning action.

Figure 3:
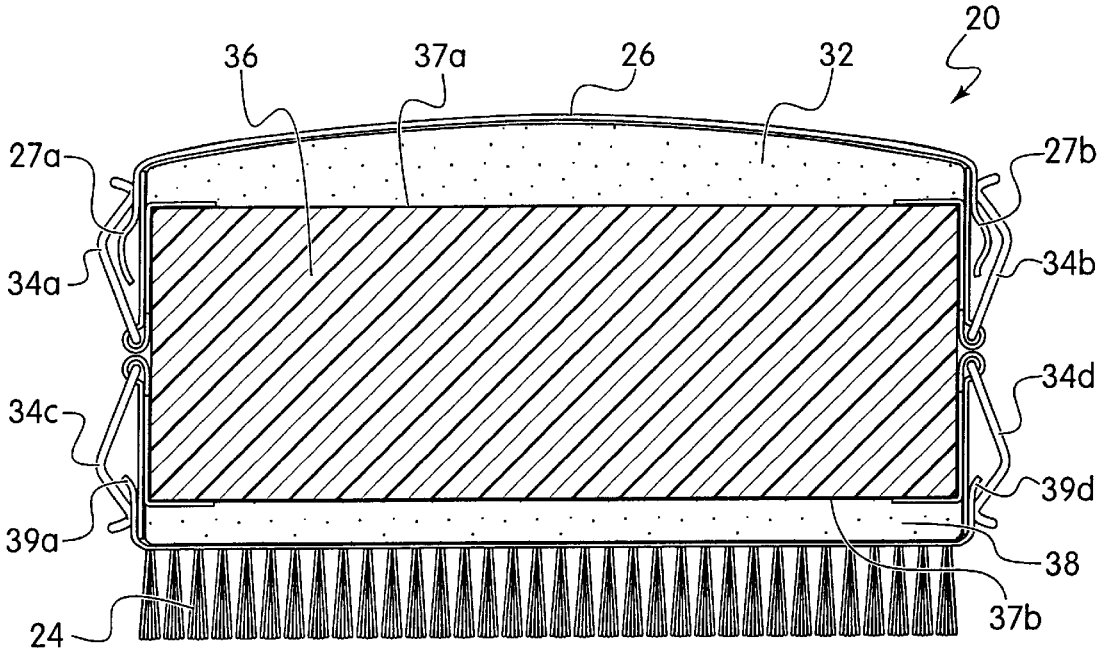
FIG. 3 is a partial cross-section of the cleaning head according to the invention.

FIG. 3 shows a partial cross-section of cleaning head 20. Cleaning head 20 has a solid head portion 36 made of any suitable known material, such as, for example, plastics, wood, metals, etc. The top and bottom surfaces 37*a* and 37*b*, respectively, have different cleaning surfaces 26 and 24, respectively for different cleaning applications. Cleaning surface 24 can be a scrub brush (as shown) for a more abrasive cleaning action, and cleaning surface 26 can be cloth-like head for polishing and less abrasive cleaning. In the preferred embodiment, cleaning surface 26 is made of a disposable surgical towel. Surgical towels provide superior drying and buffing action on glass surfaces.

Figure 4:
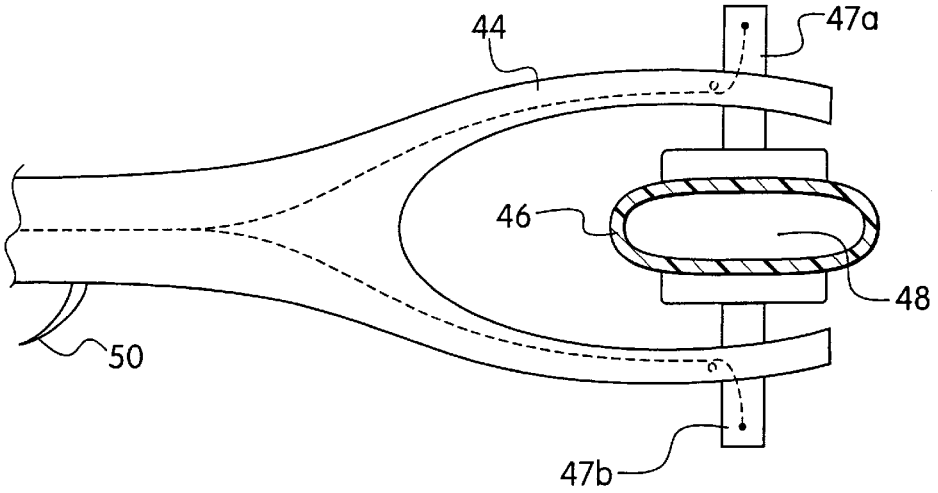
FIG. 4 is a partial cross-section of an oven cleaning head according to the invention.

Cleaning head 20 can be replaced with an oven type cleaner 44 (FIG. 4). Oven cleaner attachment 44 connects to index 22, and provides an oven cleaning head 46 that includes an internal chamber 48 for retaining a cleaning lye. A lever 50 is connected to the head 46 through means of a pulley system. Upon activation of lever 50, members 47*a* and 47*b* are pressed together on head 46 to force the extrusion of the cleaning lye contained in chamber 48. The combination of this cleaning head with the vibratory action of device 10 provides a superior over-cleaning effect while reducing the amount of physical exertion required to clean the oven surface. In an alternative embodiment, an oven cleaner is applied to the oven surface, and oven attachment 44 does not require lye to be contained in chamber 48.

Each cleaning surface 24 and 26 can be releasably disposed on head portion 36 through the use of spring clips 34*a*–34*d*. Cleaning surface 26, for example, is designed with tabs 27*a* and 27*b*, such that when disposed on surface 37*a*, these tabs overhang the edges of head portion 36. Spring clips 34*a* and 34*b* engage tabs 27*a* and 27*b*, respectively, to secure cleaning surface 26 in place.

Cleaning surface 24 includes similar tabs 39*a* and 39*b* for releasably securing the cleaning surface to head portion 36, via spring clips 34*c* and 34*d*, respectively. Head portion 36 can be designed to include a flexible foam-like portion 32 and 38 on the opposite sides 37*a* and 37*b*, respectively. Flexible portions 32 and 38 provide cleaning surfaces 26 and 24 with slight flexibility which enables the surface to form to the surface to be cleaned. This increases the cleaning action of cleaning surfaces 24 and 26.

Cleaning surfaces 24 and 26 can be designed for various cleaning applications such that cleaning device 10 can perform all household cleaning jobs. Some examples of cleaning surfaces would be, a glass cleaning head, a furniture polisher, an oven cleaner, a bathroom tile and tub head, a ceramic tile scrubbing head, a buffing head, a cabinet and wood cleaner, a chamois cloth, etc. The configuration of these various cleaning heads or surfaces would include tabs, such as tabs 27*a*, 27*b*, 39*a* and 39*b*, (and VELCRO®) for releasably attaching the cleaning surface to cleaning head 20.

Figure 5:
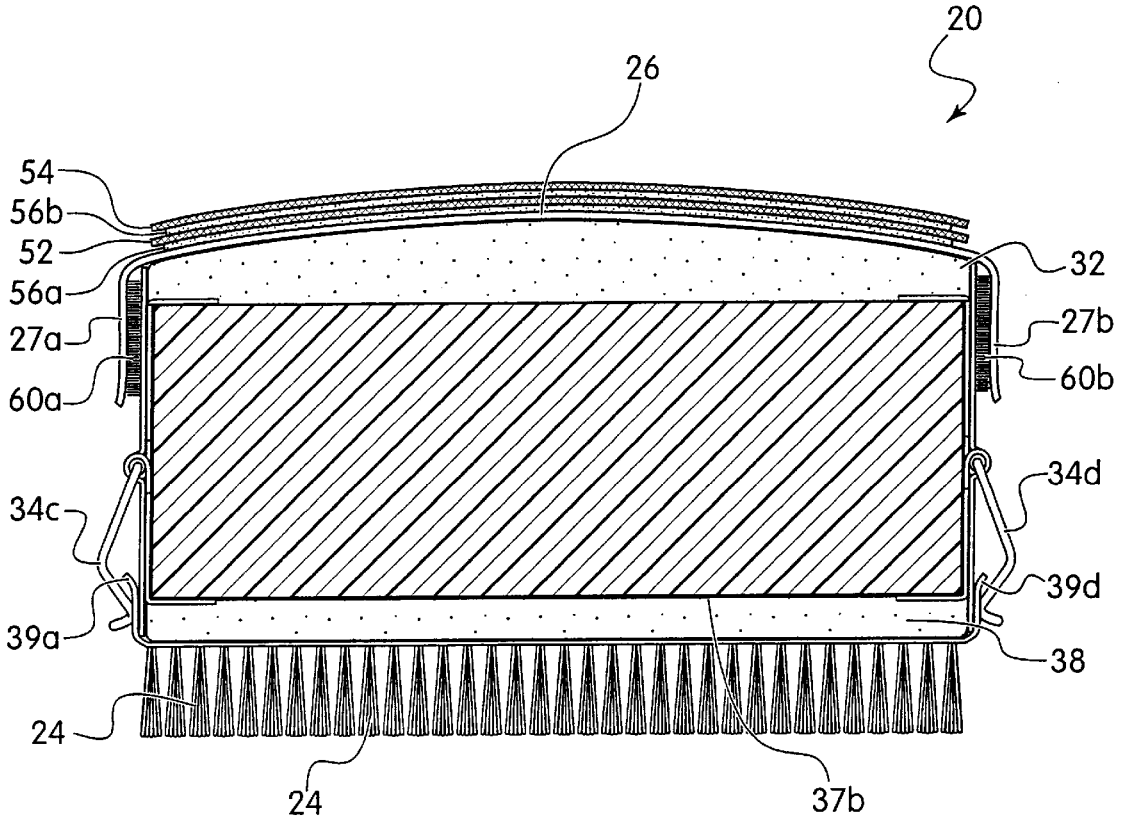
FIG. 5 is a cross-sectional view of an alternative embodiment of the invention.

FIG. 5 shows an alternative embodiment of cleaning surface 26 having cleaning layers 52 and 54. Cleaning layers 52 and 54 have adhesive layers 56*a* and 56*b*, respectively, for adhering the same to the underlying layer. In use, when cleaning layer 54 is dirty and should no longer be used, it is peeled off to expose a new cleaning layer 52. When the cleaning layers 52 and 54 are peeled off, their respective adhesive layers 56*a* and 56*b* remains attached to the peeled layer. Cleaning surface 26 includes tabs 27*a* and 27*b* for releasably securing the pad to cleaning head 20. Tabs 27*a* and 27*b* have a hook and loop type fastener 60*a* and 60*b* (i.e., VELCRO®) for performing the releasable connection of surface 26 to head 20.

The multi-purpose cleaning device 10 of the invention is preferably a hand held device for performing vibration cleaning in hard to reach places. The shortened length of device 10 (i.e., hand held) increases the users leverage and maneuverability during the cleaning process. Through the application of various cleaning heads, and vibration generators contained inline with the lower extension 18, cleaning device 10 provides superior cleaning action for all cleaning applications.

The vibrating motion makes for superior results in cleaning. The oscillation power created by the vibration generator is virtually unstoppable, resulting in excellent polishing, scouring, buffing, and scrubbing action due to the lower of apparent friction while still effectively rubbing the surface. Integrating the vibration generator into the handle results in greater leverage, and the length adds to the reach for convenience in scouring tubs, cleaning patio glass windows, and full length mirrors.

While several embodiments of the present invention have been shown and described, it is to be understood that many changes and modifications may be made thereunto without departing from the spirit and scope of the invention as defined in the appended claims.

What is claimed is:

1. A multi-purpose vibration cleaning device comprising:

a handle having two opposite ends and an on/off switch;

a vibration generator coupled to one end of said handle and being electrically connected to said on/off switch;

an extension member having one end connected to said vibration generator and an opposite end;

an adjustable pivot joint coupled to said opposite end of said extension member;

a cleaning head coupled to said adjustable pivot joint, said cleaning head having two opposing sides;

two different cleaning surfaces each located on said opposing sides of said cleaning head; and an internal power source coupled to said switch and said vibration generator, wherein said internal power source drives said vibration generator, that in turn drives said cleaning head so that said cleaning surfaces will vibrate and clean a surface.

2. The multi-purpose cleaning device according to claim 1, wherein said extension member is rotatably connected to said vibration generator.

3. The multi-purpose cleaning device according to claim 2, wherein said cleaning head includes spring clips for releasably securing said cleaning surface to each of said sides.

4. The multi-purpose cleaning device according to claim 2, wherein the cleaning surfaces of said cleaning head are selected from a group consisting of a glass cleaning surface, a furniture polishing surface, an oven cleaning surface, a bathroom tile and tub surface, a ceramic tile scrubbing surface, a wood and paneling surface, and a buffing surface.

5. The multi-purpose cleaning device according to claim 2, wherein said extension member has a range of rotation of 0–180°, said rotational motion of said extension member and said adjustable pivot joint providing said cleaning head with three dimensional freedom of motion.

6. The multi-purpose cleaning device according to claim 1, wherein said internal power source is a rechargeable battery.

* * * * *